United States Patent [19]

Glanzmann

[11] Patent Number: 4,491,311

[45] Date of Patent: Jan. 1, 1985

[54] APPARATUS FOR OPENING FOLDED SHEETS USING ACCELERATING AND DEACCELERATING SPREADER ELEMENTS

[75] Inventor: Alfred Glanzmann, Reiden, Switzerland

[73] Assignee: Grapha-Holding AG, Hergiswil, Switzerland

[21] Appl. No.: 417,526

[22] Filed: Sep. 13, 1982

[30] Foreign Application Priority Data

Sep. 22, 1981 [CH] Switzerland ..... 6101/81

[51] Int. Cl.[3] ..... B65H 39/02

[52] U.S. Cl. ..... 270/54; 271/11; 271/30 A; 271/5; 271/96; 271/100

[58] Field of Search ..... 270/11, 60, 58, 54–55, 270/52; 164/69.1; 271/90–92, 96, 108, 5, 11, 100, 30 A, 202

[56] References Cited

U.S. PATENT DOCUMENTS

| | | | |
|---|---|---|---|
| 2,211,418 | 8/1940 | Hallden | 164/69.1 |
| 3,809,384 | 5/1974 | Zugel | 270/54 |
| 4,085,927 | 4/1978 | Muller | 270/54 |
| 4,162,066 | 7/1979 | McCain et al. | 270/54 |
| 4,241,907 | 12/1980 | McCain et al. | 270/54 |
| 4,299,378 | 11/1981 | Muller | 270/54 |
| 4,350,327 | 9/1982 | Muller | 270/54 |

*Primary Examiner*—E. H. Eickholt
*Attorney, Agent, or Firm*—Peter K. Kontler

[57] ABSTRACT

Apparatus for opening up folded sheets has a rotary withdrawing conveyor which extracts successive folded sheets from a stack and places successive withdrawn sheets into a path between two rotary spreading elements in such a way that the front edges of the sheet in the path are adjacent to the respective spreading elements and the back of the sheet is located at a level above the front edges. The spreading elements are driven in opposite directions and carry jaws which engage the respective front edges of a sheet therebetween in first angular positions of the spreading elements, whereupon the jaws move the sheet downwardly to move its front edges apart and to separate it from the withdrawing conveyor, and ultimately release the sheet in second angular positions of the spreading elements so that the sheet can descend onto a removing conveyor. The spreading elements are rotated by a crank drive which causes each spreading element to be accelerated during one half and to be decelerated during the other half of each of its revolutions. The spreading elements are in the process of being accelerated when they assume their first angular positions, and the spreading elements are in the process of being decelerated, or their peripheral speeds are relatively low, when they assume their second angular positions.

11 Claims, 3 Drawing Figures

APPARATUS FOR OPENING FOLDED SHEETS USING ACCELERATING AND DEACCELERATING SPREADER ELEMENTS

BACKGROUND OF THE INVENTION

The present invention relates to apparatus for manipulating sheets, especially folded sheets which can constitute component parts of signatures or the like. More particularly, the invention relates to improvements in apparatus of the type wherein a conveyor withdraws successive folded sheets from a source of supply and advances the withdrawn sheets into a path wherein the folded back of the sheet is located behind the two front edges and wherein two rotary spreading or opening elements flank the path and are provided with jaws, grippers or analogous means for engaging the respective front edges and for moving them apart while the sheet advances along its path.

Apparatus of the above outlined type are often used in bookbinding and like machines. Reference may be had to commonly owned U.S. Pat. No. 4,085,927 granted Apr. 25, 1978 to Hans Müller and to commonly owned U.S. Pat. No. 4,299,378 granted Nov. 10, 1981 to Hans Müller. The arrangement is normally such that the spreading elements rotate at an average speed, that they engage and begin to open a sheet when they assume predetermined first angular positions, and that they release the opened sheet in second angular positions so that the sheet can descend onto the upper reach of a removing device, such as a chain conveyor or the like. The trend in the design of machines utilizing such apparatus is to greatly increase their output; however, this should not affect the reliability of withdrawal of successive sheets from the source and/or the reliability of the spreading or opening operation. Thus, the conveyor which withdraws the sheets from the source of supply must reliably engage successive sheets preparatory to advancement of the thus engaged sheets into the aforementioned path, and the jaws of the spreading elements must engage the respective front edges of successive sheets with an equally high degree of reliability and reproducibility. Certain presently known proposals for enhancing the reliability of engagement between successive sheets and the withdrawing conveyor, as well as between successive sheets and the spreading elements, are disclosed, for example, in Swiss Pat. Nos. 374,968 and 617,905, in British Pat. No. 901,816 and in the aforementioned U.S. Pat. No. 4,299,378 to Müller.

The speed of transport of successive folded sheets in heretofore known machines cannot be increased at will without risking at least some misalignment of sheets which are deposited on the removing conveyor. This is due to the fact that the resistance of air to advancement of opened sheets toward the removing conveyor increases with the square of increasing speed of advancement of successive sheets along their path. In order to reduce the likelihood of misalignment of sheets which are transported at an elevated speed, the aforementioned U.S. Pat. No. 4,085,927 to Müller discloses the utilization of nozzles which blow compressed air against the outer sides of opened sheets so as to accelerate the sheets on their way toward the removing conveyor as well as to ensure that the sheets are properly guided during travel toward such conveyor. It has been found that the accelerating and guiding action of nozzles is rather limited, i.e., they cannot do the job when the speed of transport of successive folded sheets is increased beyond a certain threshold value.

OBJECTS AND SUMMARY OF THE INVENTION

An object of the invention is to provide a novel and improved apparatus for singularizing and opening folded sheets in bookbinding or other types of machines, and to construct and assemble the apparatus in such a way that it can ensure predictable transport of successive sheets, even if their speed is increased well above the speeds which are permissible in heretofore known apparatus.

Another object of the invention is to provide the apparatus with novel and improved means for driving the spreading or opening elements.

A further object of the invention is to provide the apparatus with novel and improved means for timing the engagement between the spreading elements and the front edges of successive folded sheets.

An additional object of the invention is to provide novel and improved means for timing the disengagement of the spreading elements from the front edges of successive folded sheets.

A further object of the invention is to provide a novel and improved method of manipulating folded sheets in the course of their transport from a source of supply to a removing conveyor for opened sheets.

The invention is embodied in an apparatus for manipulating folded sheets of the type having a back (where the two panels of the sheet meet) and two front edges which are spaced apart from and normally parallel to the back. The apparatus comprises a chain conveyor or another suitable source of supply of folded sheets, withdrawing conveyor means (e.g., a rotary drum-shaped conveyor) arranged to advance successive sheets from the source into a predetermined path wherein the back of a sheet trails the front edges (the back is normally disposed at a level above the front edges), and a pair of spreading elements which are rotatable in opposite directions and flank the aforementioned path. The spreading elements have jaws or other suitable gripping means which serve to engage the respective front edges of successive sheets in the aforementioned path in predetermined first angular positions of the spreading elements and to move the thus engaged front edges away from one another while advancing the corresponding sheet along the path, and to release the respective front edges of a thus advanced sheet in predetermined second angular positions of the spreading elements. The apparatus further comprises drive means for rotating the spreading elements at a plurality of different peripheral speeds during each revolution of the spreading elements, and such speeds include a first range of preferably progressively (gradually) increasing speeds and a second range of preferably progressively (gradually) decreasing speeds. The speeds within each of the two ranges include speeds above and speeds below a predetermined average peripheral speed, and the spreading elements assume their second angular positions when their peripheral speeds are at least approximately within the second range of speeds. The arrangement is preferably such that the spreading elements assume their second angular positions when their peripheral speeds are at least slightly below the maximum peripheral speed. As a rule, the peripheral speeds will increase during a first half and decrease during a second half of each revolution of the spreading elements. Also, the spreading elements preferably assume their first angular positions when their speeds are within the first range of speeds, e.g., when their speeds match, approximate or are less than the average peripheral speed.

The spreading elements can assume their second angular positions when their peripheral speeds are below the average speed, e.g., when their peripheral speeds match or approximate the minimum speed which may but need not equal zero.

The drive means for the spreading elements can comprise a crank drive, and such crank drive can derive motion from the drive means for the withdrawing conveyor means. For example, the drive means for the withdrawing conveyor means can comprise a chain and sprocket wheel drive, and the crank drive can receive motion from such chain and sprocket wheel drive through the medium of mating spur gears or other suitable motion transmitting elements.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
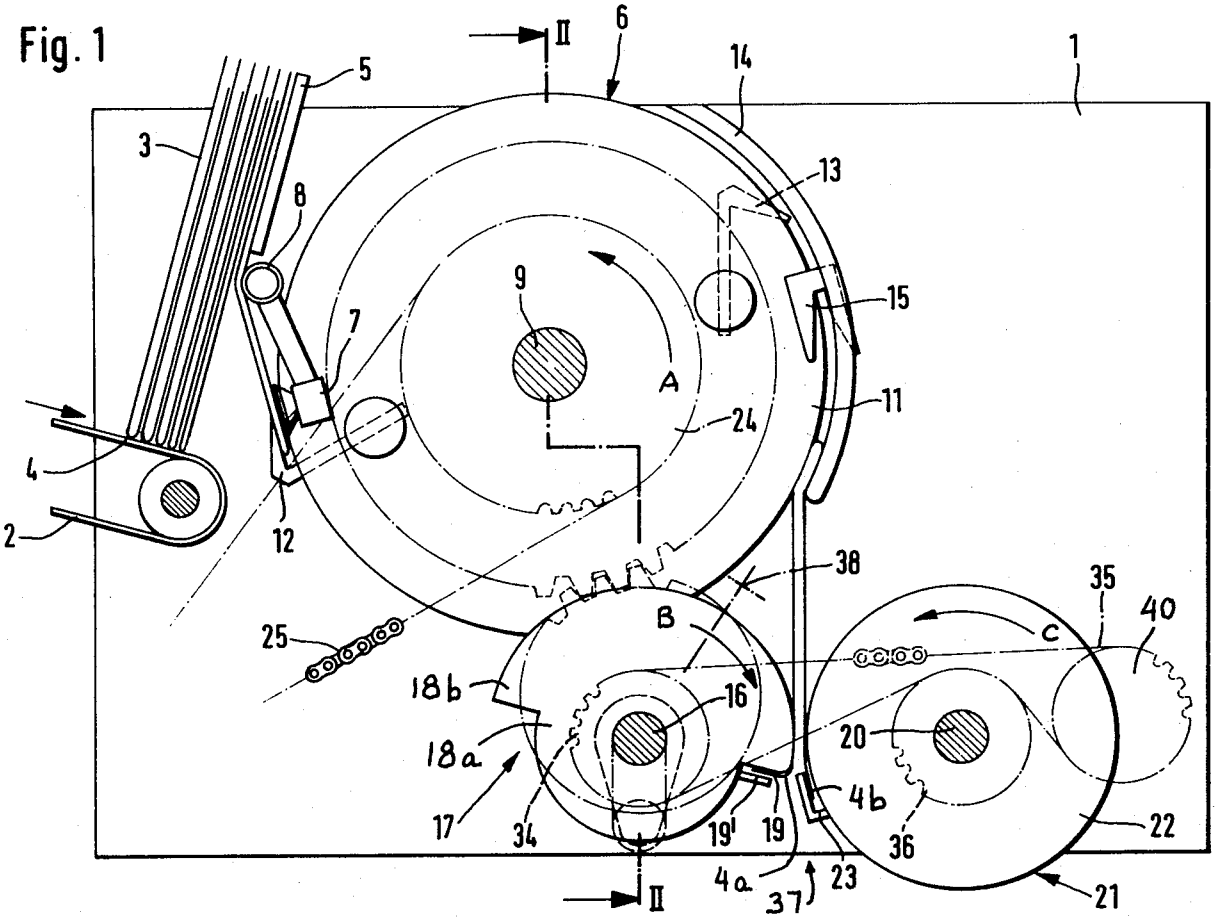
FIG. 1 is a sectional view of an apparatus which embodies the invention, the section being taken in the direction of arrows as seen from the line I—I of FIG. 2.
Figure 2:
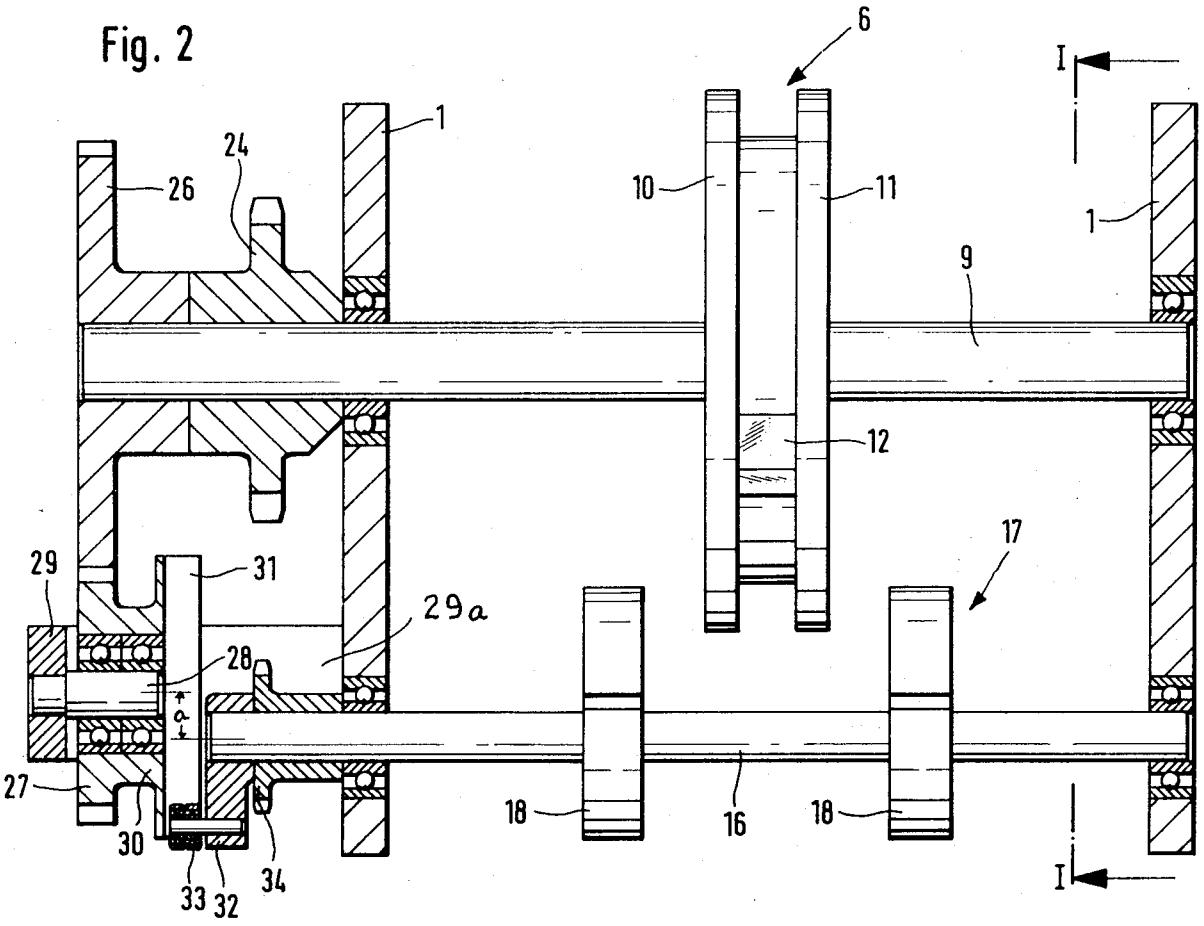
FIG. 2 is a sectional view as seen in the direction of arrows from the line II—II of FIG. 1.

The apparatus which is shown in FIGS. 1 and 2 comprises a frame having two spaced apart upright sidewalls or cheeks 1 flanking the discharge end of a sheet feeding belt conveyor 2 whose upper reach supports a stack of parallel folded sheets 3 each having a back 4 and two front edges **4*a*, 4*b* which are slightly offset with reference to one another. The foremost sheet 3 of the stack on the conveyor 2 abuts against a platelike stop 5** which is mounted in the frame.

Successive foremost sheets 3 of the stack on the conveyor 2 are removed by a rotary drum-shaped withdrawing conveyor 6 which cooperates with a row of pivotable suction cups 7 mounted on an oscillatable tubular carrier 8 which is installed in the frame and connects the suction cups 7 to a suction generating device (not shown) during movement of suction cups from first end positions in which the suction cups are adjacent to the back 4 of the foremost sheet 3 on the conveyor 2 and second end positions (shown in FIG. 1) in which the back 4 of such foremost sheet is in the range of a gripper 12 or 13 between the coaxial circular discs 10 and 11 of the rotating withdrawing conveyor 6. The latter is rigid with a shaft 9 which is rotatably journalled in the sidewalls 1 of the frame. The grippers 12 and 13 of the withdrawing conveyor 6 are disposed diametrically opposite each other with reference to the shaft 9. Each of the two grippers 12 and 13 is pivotable between an operative or extended position (note the gripper 12 in FIG. 1) and an inoperative or retracted position (note the gripper 13 in FIG. 1). In their retracted positions, the grippers 12 and 13 are located within the confines of the discs 10 and 11, i.e., they do not extend radially beyond the peripheral surfaces of such discs. In its operative position, the gripper 12 or 13 projects beyond the discs 10, 11 and urges the back 4 of a freshly accepted sheet 3 against the peripheral surfaces of the two discs. The means for actuating the grippers 12 and 13 in synchronism with back-and-forth movements of the suction cups 7 and in synchronism with the operation of means which drives the shaft 9 preferably comprises a set of cams the exact construction and mounting of which form no part of the present invention. Reference may be had to the aforementioned U.S. Pat. No. 4,299,378 to Müller whose disclosure (as well as the disclosure of U.S. Pat. No. 4,085,927) is incorporated herein by reference.

The withdrawing conveyor 6 is partially surrounded by a part-cylindrical slotted shroud 14 which carries an adjustable stop 15 serving to arrest and properly locate the back 4 of a freshly withdrawn sheet 3. The stop 15 is movable lengthwise of the slot in the shroud 14; such slot extends in the circumferential direction of the withdrawing conveyor 6. The position of the stop 15 with reference to the shroud 14 will be adjusted in dependency on the dimensions of sheets 3 which are stacked on the conveyor 2.

The withdrawing conveyor 6 is mounted at a level above two rotary opening or spreading elements 17 and 21 which are respectively mounted on shafts 16 and 20. The shaft 16 is rotatable in the sidewalls 1 of the frame and is rigidly connected with the two discs 18 of the spreading element 17. The discs 18 include smaller-diameter sectors **18*a* and larger-diameter sectors 18*b*. Each such sector extends along an arc of 180°. The distance between the shafts 9 and 16 is selected in such a way that the larger-diameter sectors 18*b* of the discs 18 overlap the discs 10, 11 of the withdrawing conveyor 6, as considered in parallelism with the axes of the shafts 9 and 16. This ensures that a radial shoulder 19 between the larger-diameter and smaller diameter sectors 18*b*, 18*a* of each disc 18 reliably engages the outer side of the adjacent front edge 4*a* of a sheet 3 whose back 4 abuts against the stop 15. The shoulders 19 of the discs 18 cooperate with grippers or jaws 19' which engage the inner side of the sheet 3, while the back 4 of such sheet abuts against the stop 15, whereby the spreading element 17 positively engages the sheet and pulls it out of the arcuate gap between the peripheries of the discs 10, 11 and the shroud 14**.

The second spreading element 21 comprises two axially spaced discs 22 which are rigidly connected to the shaft 20 and flank an open-and-shut gripper or jaw 23. The shaft 20 is rotatable in the sidewalls 1 of the frame. The jaw 23 engages the other front edge **4*b* of a sheet 3 whose back 4 abuts against, or is still very close to, the stop 15 and whose front edge 4*a* is engaged by the jaws 19' of the spreading element 17. The arrows B and C of FIG. 1 indicate that the spreading elements 17, 21 are driven to rotate in opposite directions so that, once the front edges 4*a*, 4*b* of a sheet 3, whose back 4 abuts against the stop 15, are properly engaged by the respective jaws 19' and 23, such sheet is compelled to advance downwardly, as viewed in FIG. 1, and to be thus extracted from the aforementioned arcuate gap between the peripheries of the discs 10, 11 and the inner side of the shroud 14**.

The shaft 9 (and hence the withdrawing conveyor 6) is driven by an endless chain or belt conveyor 25 through the medium of a sprocket wheel or pulley 24 which is rigidly connected to the shaft 9. The chain or belt conveyor 25 receives motion from a suitable timing or synchronizing shaft, not shown.

The shaft 9 is further rigidly connected with a gear 26 in mesh with a gear 27 which is free to rotate on a stub shaft 28. The latter is mounted in a bearing element 29 which is affixed to the left-hand sidewall 1 of FIG. 2 by a bracket or yoke 29*a*. The gear 27 is integral with or is rigidly connected to a rotary cam 30 which has a diametrically extending cam groove 31 facing the adjacent sidewall 1 of the frame. The cam 30 is coaxial with the stub shaft 28. As can be seen in the lower portion of FIG. 2, the shaft 16 is parallel to the stub shaft 28; the spacing between the parallel axes of such shafts is shown at a. That end portion of the shaft 16 which is adjacent to the cam 30 carries a crank arm 32 extending radially of the shaft 16 and carrying a roller follower 33 which extends into the groove 31 of the cam 30. Still further, the shaft 16 carries and is rigid with a sprocket wheel or pulley 34 for an endless chain or belt conveyor 35 which is further trained over a sprocket wheel or pulley 40 and one reach of which engages a sprocket wheel or pulley 36 on the shaft 20 for the spreading element 21. This ensures that, when the cam 30 is driven by the gear 27, the spreading elements 17 and 21 are caused to rotate in opposite directions.

Figure 3:
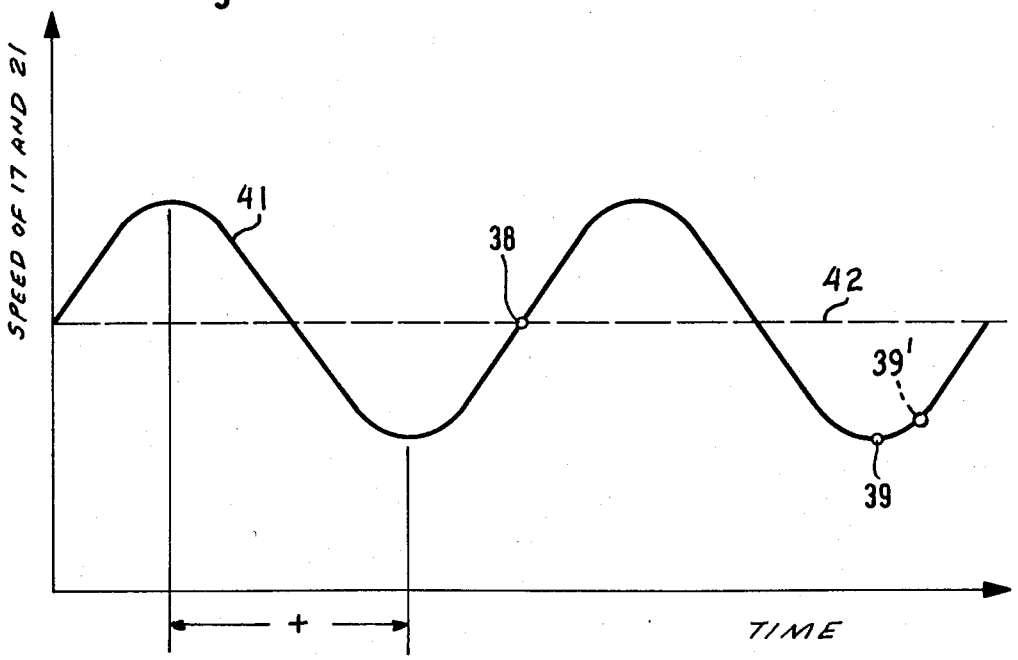
FIG. 3 is a diagram wherein the curve denotes the fluctuations of peripheral speed of the spreading elements during each revolution of their shafts.

It is assumed that the chain or belt conveyor 25 drives the sprocket wheel or pulley 24 and the shaft 9 (with the withdrawing conveyor 6) at a constant speed in the direction of arrow A shown in FIG. 1. This causes the gears 26, 27 to rotate the cam 30 at a constant speed but the crank drive (including the cam 30, the follower 33 and the crank arm 32) causes the shaft 16 (and hence the spreading elements 17, 21) to rotate at an alternately increasing and decreasing peripheral speed. This is attributable to eccentricity a of the axis of the shaft 16 relative to the axis of the stub shaft 28. It can be said that, during each revolution of the shaft 16, the crank drive including the members 30, 32 and 33 causes gradual acceleration of the spreading elements 17, 21 above and gradual deceleration of such spreading elements below an average speed. This is illustrated in FIG. 3 wherein the curve 41 denotes the speed of the spreading elements 17, 21 as a function of time, and the horizontal broken line 42 denotes the average speed. The amplitude of peripheral speed of the spreading elements 17 and 21 can be varied by changing the eccentricity a of the axis of the shaft 16 relative to the axis of the stub shaft 28 and/or by changing the effective length of the crank arm 32. The minimum speed of the spreading elements 17 and 21 can be reduced to zero; however, this would necessitate a pronounced increase of sturdiness of the apparatus owing to highly pronounced acceleration and deceleration of the spreading elements 17, 21 between zero speed and the desired or required maximum speed.

The operation of the improved apparatus is as follows:

The foremost folded sheet 3 which abuts against the stop 5 maintains its back 4 in the range of the section cups 7 which oscillate back and forth about the axis of their tubular carrier 8. The suction cups 7 attract the back 4 when they assume their left-hand end positions and are then connected with the suction generating device (via carrier 8) so that they flex the back 4 to the position shown in FIG. 1, namely, into the range of the oncoming gripper 12 of the withdrawing conveyor 6. The latter rotates in the direction of arrow A so that the gripper 12 extracts the foremost sheet 3 from the space between the stop 5 and the next-following sheet 3 on the conveyor 2. The gripper 12 releases such sheet when the back 4 reaches the adjustable stop 15 on the shroud 14. At the same time, the gripper 13 advances toward the transfer station between the conveyors 2 and 6 to engage the back 4 of the next foremost sheet 3. The front edge 4*a* of the sheet 3 whose back 4 abuts against the stop 15 is engaged by the jaws 19' of the spreading element 17 when the latter assumes the first angular position 38, and the jaw 23 of the spreading element 21 engages the front edge 4*b* of the same sheet shortly or immediately thereafter. The spreading elements 17 and 21 respectively rotate in the directions which are indicated by the arrows B and C whereby the sheet 3 is opened up, i.e., its front edges 4*a* and 4*b* are moved away from one another while the peripheral surfaces of the larger-diameter sectors 18*b* of the discs 18 begin to cooperate with the peripheral surfaces of the discs 22 to extract the sheet 3 from the arcuate gap between the conveyor 6 and the shroud 14. Actually, the parts 18*b* and 22 merely pinch the panels of the sheet 3 while the jaws 19' and 23 move away from one another and thereby extract the sheet from the aforementioned gap. Spreading or opening of the sheet 3 takes place at a level above a removing chain conveyor 37 which is driven to move at right angles to the plane of FIG. 1. The jaws 19' and 23 of the spreading elements 17 and 21 release the respective front edges 4*a* and 4*b* of the sheet 3 before the sheet is actually free to move relative to the spreading elements, i.e., before the back 4 of such sheet advances downwardly and beyond the nip of the sectors 18*b* and discs 22. These parts actually propel the opened-up sheet 3 downwardly toward the removing conveyor 37 provided, of course, that the speed of the spreading elements 17 and 21 exceeds zero when the back 4 moves beyond the aforementioned nip. Such propulsion takes place in predetermined second angular positions of the spreading elements 17 and 21; one such second position is indicated in FIG. 3, as at 39.

When the jaws 19' engage the front edge 4*a* of a sheet 3 whose back 4 abuts against the stop 15, the spreading elements 17 and 21 are in the process of being accelerated by the crank drive 30, 32, 33 through the medium of the shaft 16. As shown in FIG. 3, the speed of the spreading elements 17 and 21 in their first predetermined angular positions (38) may match the average speed (line 42) of such spreading elements. The speed of the spreading elements 17 and 21 thereupon continues to increase so that their speed during that stage of each revolution when the peripheral surfaces of the larger-diameter sectors 18*b* of the discs 18 move along the peripheral surfaces of the discs 22 is above the average speed 42. This renders it possible to employ a withdrawing conveyor 6 whose diameter is relatively small but which, nevertheless, comprises more than a single gripper (in the illustrated embodiment, the conveyor 6 carries two grippers 12 and 13).

As shown in FIG. 3, the second angular positions (39) of the spreading elements 17 and 21 can be selected in such a way that their peripheral speed then assumes its minimal value, i.e., the speed of the spreading elements at the time their jaws 19' and 23 release the respective front edges 4*a* and 4*b* of a sheet which is being pinched between the sectors 18*b* and discs 22 can correspond to the minimum speed and is well below the average speed (denoted by the line 42). Such deceleration of the sheet 3 prior to release by the spreading elements 17 and 21 ensures that the spread-apart front edges 4*a* and 4*b* move toward each other (rather than further apart owing to the resistance of air adjacent to the undersides of the panels of the sheet 3) during descent of the sheet toward and onto the removing conveyor 37. Such prevention of spreading of the sheets 3 under the action of air between the nip of the sectors 18*b* and the discs 22 on the one hand and the tip or crest of the removing conveyor 37 on the other hand reduces the likelihood of improper deposition of opened sheets on the removing conveyor because the resistance of air is less likely to be an important factor or to exert any influence upon the orientation of sheets which are in the process of descending onto the conveyor 37.

It is within the purview of the invention to place the second angular positions (39) anywhere into that stage of each revolution of the spreading elements 17 and 21 when the peripheral speed of such spreading elements decreases, i.e., when the speed of downward movement of the sheets from the conveyor 6 toward the conveyor 37 is on the decrease. With reference to FIG. 3, this could place the second angular positions anywhere within the interval t. At the present time, it is preferred to select the second angular positions (39) in a manner as actually shown in FIG. 3, i.e., to time the arrival of the spreading elements 17 and 21 to such second predetermined positions in such a way that it coincides with the minimal speed of downward movement of the sheets 3 because, at such time, the resistance which the surrounding air offers to downward movement of the sheets (and hence the extent of unpredictable opening of sheets under the action of the cushion of air which is adjacent to the inner sides of the panels of the sheets) is less pronounced than during any other stage of downward movement of the sheets.

FIG. 3 illustrates one of the presently preferred modes of operation of the drive means for the spreading elements 17 and 21, i.e., the speed of the spreading elements is on the increase when the jaws 19' and 23 engage the respective front edges 4*a*, 4*b* of a sheet 3, and the speed of the spreading elements is reduced to a minimal value when the back 4 of such sheet descends below the nip of the sectors 18*b* and discs 22. At the very least, the second predetermined positions of the spreading elements 17, 21 (namely, the positions in which the spreading elements become disengaged from a sheet 3) should be reached during that stage of each revolution of the spreading elements when the peripheral speed of such spreading elements is on the decrease or is relatively low. This brings about the advantage that the sectors 18*b* of the discs 18 forming part of the spreading element 17 can overlap the discs 10 and 11 of the withdrawing conveyor 6 (as disclosed in Swiss Pat. No. 408,065) even if the diameter of the withdrawing conveyor is relatively small. This is due to the fact that the sectors 18*b* move beyond the nip of the spreading elements 17 and 21 before the oncoming gripper 12 or 13 of the withdrawing conveyor 6 advances the back 4 of a freshly removed sheet 3 into the region where the sectors 18*b* and the discs 22 overlap for a certain interval of time during each revolution of the spreading element 17. Moveover, the just discussed selection of the angular positions 38 and 39 ensures that the withdrawing conveyor 6 can carry several grippers, such as the grippers 12 and 13 which are disposed diametrically opposite each other with reference to the axis of the shaft 9.

It has further been ascertained that optimum conditions prevail when the spreading elements 17 and 38 reach the predetermined positions 38 while their peripheral speed matches or at least approximates the average speed (line 42) of the spreading elements, and the spreading elements reach the second predetermined positions (39) when their peripheral speed matches or at least approximates the minimum speed. The second angular positions can be moved into an upwardly sloping part of the curve 41, expecially if the minimum peripheral speed of the spreading elements 17 and 21 is low or equals or approaches zero. For example, if the minimum speed of the spreading elements 17 and 21 is nearer to the abscissa than shown in the ordinate system of FIG. 3, the second angular positions of such spreading elements can be located in the ascending portion of the curve 41, e.g., at 39'. All that counts is to ensure that the sheets 3 can be rapidly withdrawn from the gap between the conveyor 6 and shroud 14 but that their speed at the time of release by the jaws 19' and 23 is sufficiently low to prevent the body of air between the conveyors 6 and 37 from unduly influencing the orientation and/or the extent of opening of unsupported sheets which can be said to "float" during the last stage of their downward movement onto the conveyor 37.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for manipulating folded sheets of the type having a back and two front edges, comprising a source of supply of folded sheets; withdrawing conveyor means arranged to advance successive sheets from said source into a predetermined path wherein the back of a sheet trails the front edges thereof; a pair of spreading elements rotatable in opposite directions and flanking said path, each of said spreading elements having gripping means arranged to engage the respective front edges of successive sheets in predetermined first angular positions of said spreading elements and to move the thus engaged front edges away from one another while advancing the corresponding sheet along said path, and to release the respective front edges in predetermined second angular positions of said spreading elements; and drive means for rotating said spreading elements at a plurality of different peripheral speeds during each revolution of said spreading elements, said speeds including a first range of increasing speeds and a second range of decreasing speeds and the speeds within each of said ranges including speeds above and speeds below a predetermined average peripheral speed, said spreading elements assuming said second angular positions when their peripheral speeds are at least approximately within said second range.

2. The apparatus of claim 1, wherein said speeds include a maximum peripheral speed and said spreading elements assume said second angular positions when their peripheral speeds are at least slightly below said maximum speed.

3. The apparatus of claim 1, wherein said spreading elements assume said first angular positions when their speeds are within said first range of speeds.

4. The apparatus of claim 1, wherein said spreading elements assume said second angular positions when their speeds are less than said average speed.

5. The apparatus of claim 1, wherein said speeds include a minimum speed and said spreading elements assume said second angular positions when their peripheral speeds at least approximate said minimum speed.

6. The apparatus of claim 5, wherein said minimum speed at least approximates zero speed.

7. The apparatus of claim 1, wherein said spreading elements assume said first angular positions when their peripheral speeds at least approximate said average speed.

8. The apparatus of claim 1, wherein said spreading elements assume said first angular positions when their peripheral speeds are less than said average speed.

9. The apparatus of claim 1, wherein said drive means comprises a crank drive.

10. The apparatus of claim 9, further comprising second drive means for said withdrawing conveyor means and means for transmitting motion from said second drive means to said crank drive.

11. The apparatus of claim 1, wherein said peripheral speeds increase during a first half and decrease during a second half of each revolution of said spreading elements.

* * * * *